US010299639B2

(12) United States Patent
Stevenson et al.

(10) Patent No.: US 10,299,639 B2
(45) Date of Patent: May 28, 2019

(54) PLUMBING FIXTURE LID AND SEAT ASSEMBLY

(71) Applicant: Kohler Mira Limited, Gloucestershire (GB)

(72) Inventors: Robert Karl Stevenson, London (GB); Simon Mark Bickerstaffe, North Somerset (GB); Keith John Thompson, Berks (GB); Matthew Eric Batchelor, London (GB); Nicholas G. Paget, London (GB)

(73) Assignee: KOHLER MIRA LIMITED (GB)

( * ) Notice: Subject to any disclaimer, the term of this patent is extended or adjusted under 35 U.S.C. 154(b) by 0 days.

(21) Appl. No.: 15/601,850

(22) Filed: May 22, 2017

(65) Prior Publication Data

US 2017/0340174 A1 Nov. 30, 2017

Related U.S. Application Data

(60) Provisional application No. 62/342,085, filed on May 26, 2016.

(51) Int. Cl.

| | |
|---|---|
| ***A47K 13/12*** | (2006.01) |
| ***A47K 13/26*** | (2006.01) |
| ***A47K 13/02*** | (2006.01) |
| ***A47K 13/10*** | (2006.01) |

(52) U.S. Cl.

CPC ..... *A47K 13/12* (2013.01); *A47K 13/02* (2013.01); *A47K 13/10* (2013.01); *A47K 13/26* (2013.01)

(58) Field of Classification Search

CPC ..... A47K 13/12; A47K 13/26; A47K 13/02; A47K 13/10

See application file for complete search history.

(56) References Cited

U.S. PATENT DOCUMENTS 2,742,649 A * 4/1956 Phillips ..... A47K 13/12 4/240

5,448,781 A 9/1995 Miller (Continued)

FOREIGN PATENT DOCUMENTS

DE 19835446 2/2000
DE 10227415 1/2004

(Continued)

OTHER PUBLICATIONS

European Search Report regarding Application No. 17172162.4 dated Oct. 16, 2017 (7 pages).

(Continued)

*Primary Examiner* — Janie M Loeppke

(74) *Attorney, Agent, or Firm* — Foley & Lardner LLP

(57) ABSTRACT

A lid and seat assembly for a plumbing fixture includes a housing, a lid, and a seat. The housing includes a generally planar front surface and a generally planar rear surface. The lid is pivotably coupled to the housing. The seat is pivotably coupled to the housing. The front surface and the rear surface meet at a first edge located at a first end of the housing and at a second edge at a second end of the housing. The front surface, the rear surface, the first common edge, and the second common edge cooperatively define a continuous surface profile configured to facilitate single-wipe cleaning of the housing.

20 Claims, 13 Drawing Sheets

(56) References Cited

U.S. PATENT DOCUMENTS

| | | | | |
|---|---|---|---|---|
| 5,666,672 | A | 9/1997 | Birsel et al. | |
| 6,009,568 | A | 1/2000 | Miyazaki | |
| 6,421,842 | B1 | 7/2002 | Fujita | |
| 7,647,652 | B1 * | 1/2010 | Baker | A47K 13/12 4/236 |
| 8,631,521 | B1 | 1/2014 | Baker | |
| 2002/0162164 | A1 * | 11/2002 | Kamysz | A47K 13/145 4/243.2 |
| 2005/0217008 | A1 * | 10/2005 | Vierkant, III | A47K 13/26 4/240 |
| 2007/0226883 | A1 * | 10/2007 | Kaule | A47K 13/12 4/236 |
| 2007/0294813 | A1 | 12/2007 | Leibfried | |
| 2008/0060119 | A1 * | 3/2008 | Pinizzotto | A47K 13/302 4/217 |
| 2009/0211005 | A1 * | 8/2009 | Hand | A47K 13/12 4/240 |
| 2010/0005579 | A1 * | 1/2010 | Li | A47K 13/12 4/240 |

FOREIGN PATENT DOCUMENTS

| | | |
|---|---|---|
| DE | 202012000788 | 6/2012 |
| EP | 0619976 | 10/1994 |

OTHER PUBLICATIONS

European Official Action regarding Application No. 17172162.4 dated Oct. 25, 2018 (4 pages).

* cited by examiner

PLUMBING FIXTURE LID AND SEAT ASSEMBLY

CROSS-REFERENCE TO RELATED PATENT APPLICATIONS

This application claims the benefit of and priority to U.S. Provisional Application No. 62/342,085, filed May 26, 2016, the entire disclosure of which is hereby incorporated by reference herein.

BACKGROUND

The present application relates generally to a plumbing fixture. In particular, the present application relates to a lid and seat assembly for a plumbing fixture and a method of installing the same.

Generally speaking, a plumbing fixture, such as a toilet, a bidet, or the like, can include a lid and a seat. Typically, the lid and seat are pivotably coupled to the plumbing fixture and can each be pivoted relative to the plumbing fixture by a user to access or use the plumbing fixture. Most lid and seat assemblies, however, have a complex hinge structure for pivotably coupling the lid and seat together. Many of these hinge structures include various openings and crevices to permit relative rotational movement of the lid and/or seat. Furthermore, the hinge structure can define one or more gaps between the hinge and the plumbing fixture. These openings/crevices and gaps can result in the accumulation of dirt and bacteria around the plumbing fixture and the lid or seat, and can be difficult to clean around due to, for example, the complexity of the hinge structure shape and the spacing between the hinge and the plumbing fixture.

In addition, many lid and seat assemblies include dampers for regulating the closing or opening of the lid and seat to, for example, prevent the lid and/or seat from slamming against the plumbing fixture when a user closes the lid or seat. These dampers can be complicated to install and can require an installer or a user to install the dampers at an installation site, instead of at the factory or manufacturing level.

Most lids and seats for plumbing fixtures also include feet extending from the bottom of the lid and/or seat. These feet can contact either the top rim surface of the plumbing fixture or the top surface of the seat to protect the lid and seat. Typically, these feet have a relatively large footprint and a complex shape that can be difficult to clean around with the seat/lid at either an up or down position.

Thus, there is a need for an improved lid and seat assembly for a plumbing fixture that addresses one or more of the above noted deficiencies associated with conventional plumbing fixture lid and seat assemblies. These and other advantageous features will become apparent to those reviewing the present disclosure.

SUMMARY

One embodiment relates to a lid and seat assembly for a plumbing fixture. The lid and seat assembly includes a housing, a lid, and a seat. The housing includes a generally planar front surface and a generally planar rear surface. The lid is pivotably coupled to the housing. The seat is pivotably coupled to the housing. The front surface and the rear surface meet at a first edge located at a first end of the housing and at a second edge at a second end of the housing. The front surface, the rear surface, the first common edge, and the second common edge cooperatively define a continuous surface profile configured to facilitate single-wipe cleaning of the housing.

Another embodiment relates to a lid and seat assembly for a plumbing fixture. The lid and seat assembly includes a housing, a lid, and a seat. The housing is configured to be coupled to a plumbing fixture, and includes a first generally planar surface and a second generally planar surface located opposite the first generally planar surface. The lid is pivotably coupled to the housing. The seat is pivotably coupled to the housing. The first surface and the second surface meet at common edges located at opposite ends of the housing. The first generally planar surface, the second generally planar surface, and the common edges cooperatively define a continuous surface configured to facilitate single-wipe cleaning of the housing.

Another embodiment relates to a plumbing fixture assembly. The plumbing fixture assembly includes a plumbing fixture and a lid and seat assembly. The lid and seat assembly is removably coupled to the plumbing fixture. The lid and seat assembly includes a housing, a lid, and a seat. The housing is removably coupled to the plumbing fixture and includes a first generally planar surface and a second generally planar surface located opposite the first surface. The lid is pivotably coupled to the housing. The seat is pivotably coupled to the housing. The first generally planar surface and the second generally planar surface meet at common edges located at opposite ends of the housing. The first generally planar surface, the second generally planar surface, and the two curved edges cooperatively define a continuous surface configured to facilitate cleaning of the housing by a single-wipe along a front or a rear of the housing. The lid and seat are each configured to be pivoted relative to the housing and the plumbing fixture.

DETAILED DESCRIPTION

Referring generally to the FIGURES, disclosed herein is a lid and seat assembly for a plumbing fixture including a housing (e.g., hinge block, etc.) having structural features that minimize the accumulation of dirt and bacteria around the plumbing fixture, facilitate easier cleaning of, and around, the lid and seat assembly, and provide for a simplified installation process for lid and seat dampers by the manufacturer. In addition, the lid and seat each include structural features that provide for improvements relating to cleanliness and maintenance thereof.

Figure 1:
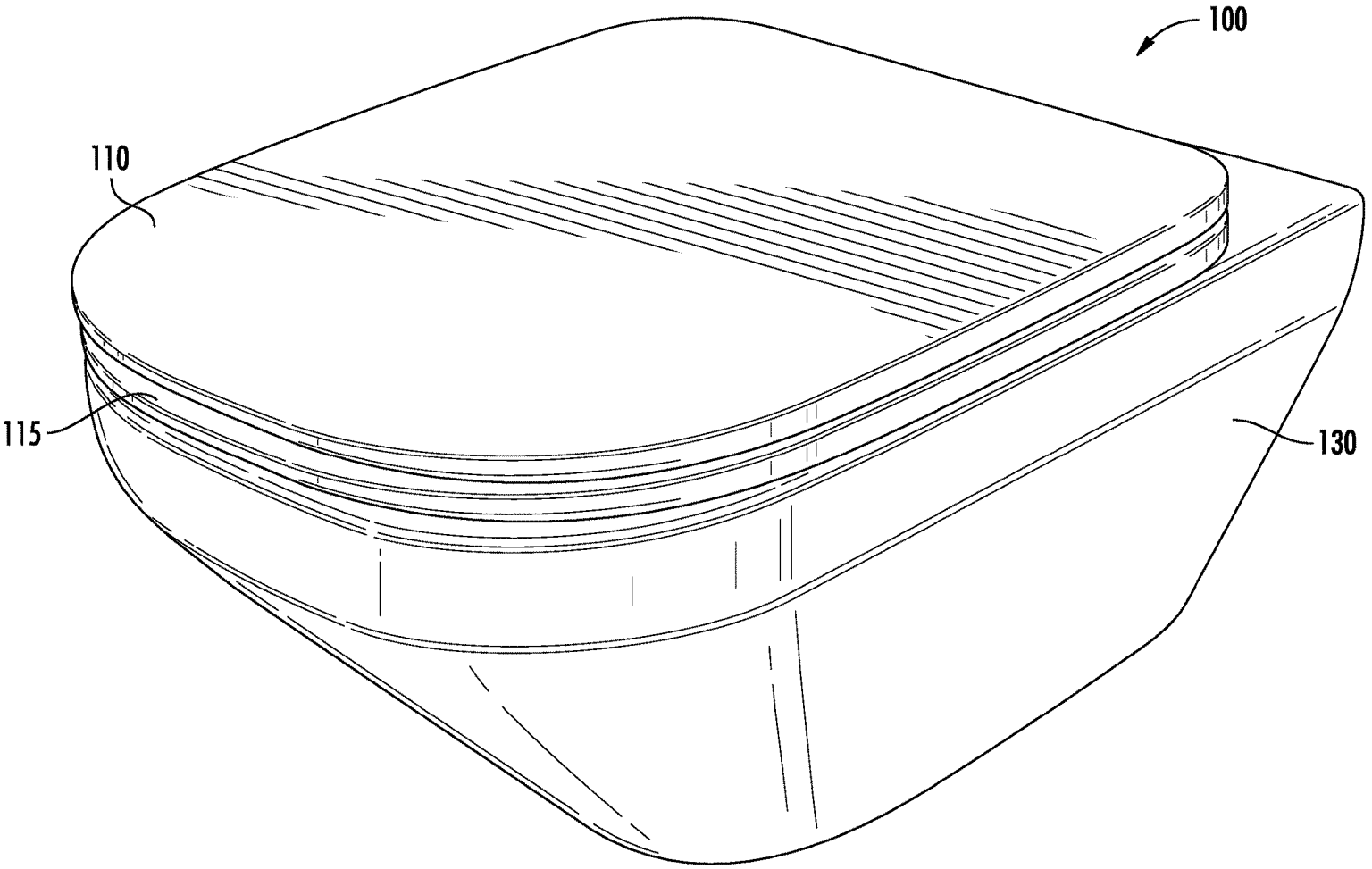
FIG. 1 is a perspective view of a plumbing fixture assembly including a lid and seat assembly according to an exemplary embodiment.
Figure 2:
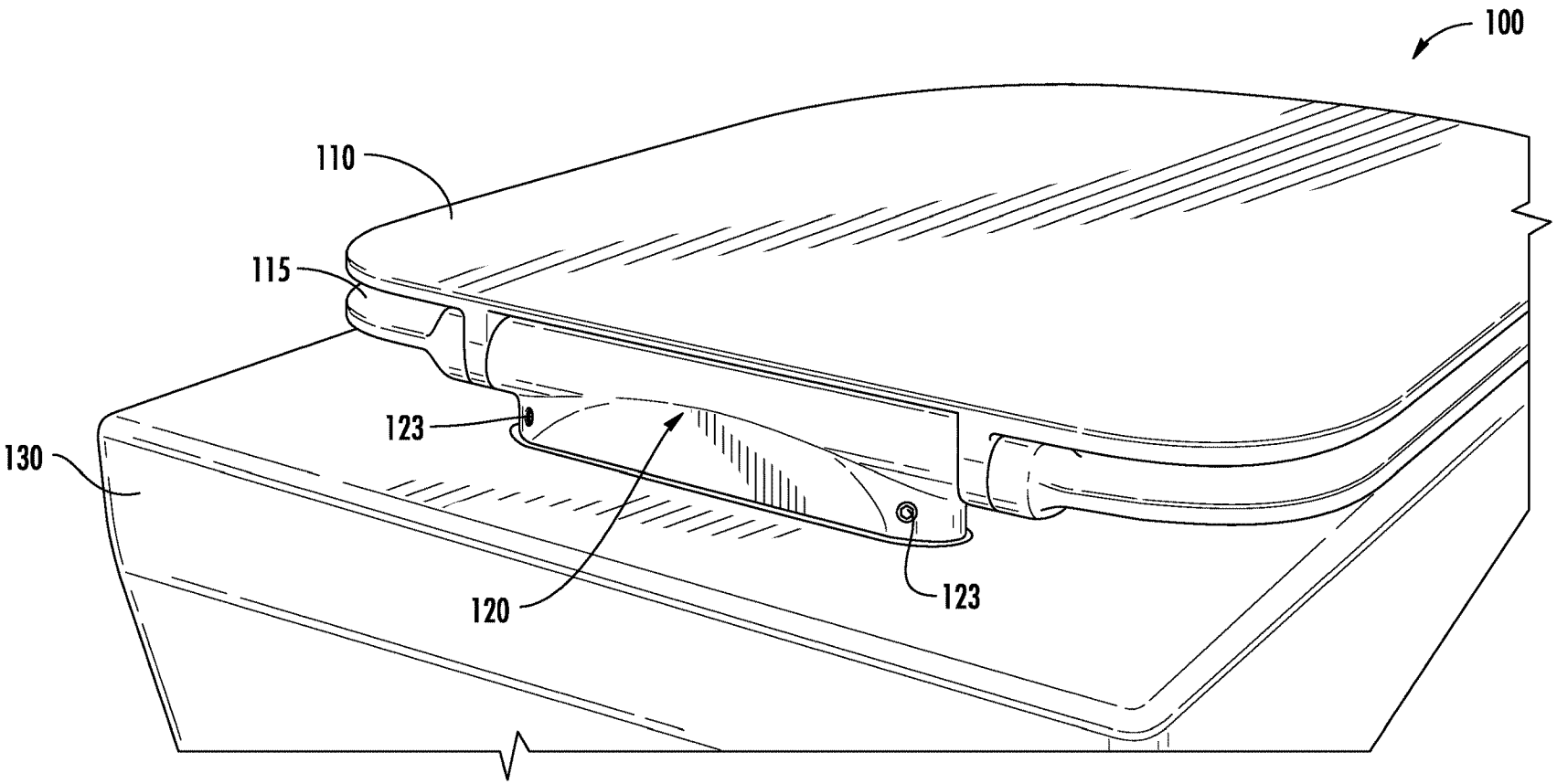
FIG. 2 is another perspective view of the plumbing fixture assembly of FIG. 1.

Referring to FIGS. 1-2, a plumbing fixture assembly 100 includes a plumbing fixture shown as a toilet 130, a lid 110, a seat 115, and a housing 120 (e.g., a hinge block, a hinge, etc.) according to an exemplary embodiment. The lid 110, the seat 115, and the housing 120 collectively define a lid and seat assembly for the toilet 130. Although the plumbing fixture assembly 100 is shown to include a toilet 100 in the exemplary embodiment of FIGS. 1 and 2, it is appreciated that the assembly can include a different type of plumbing fixture, such as a bidet, or the like, according to other exemplary embodiments. The lid 110 and the seat 115 are pivotably coupled to the toilet 130 by the housing 120. That is to say, the lid 110 and the seat 115 are each pivotably coupled to the housing 120, and the housing 120 is in turn coupled to the toilet 130. The lid 110 and the seat 115 can be selectively pivoted by a user between a down or closed position (shown in FIGS. 1 and 2) and an up or open position (see, for example, FIGS. 6-7B) relative to the housing 120 and the toilet 130, to thereby provide access to the toilet 130 for use thereof. As shown in FIG. 2, the housing 120 removably couples the lid 110 and the seat 115 to the toilet 130 via a pair fasteners 123 (e.g., set screws, bolts, etc.), the details of which are discussed in the paragraphs that follow. According to other exemplary embodiments, more or fewer than two fasteners 123 may be used to removably couple the housing 120 to the toilet 130.

Figure 3:
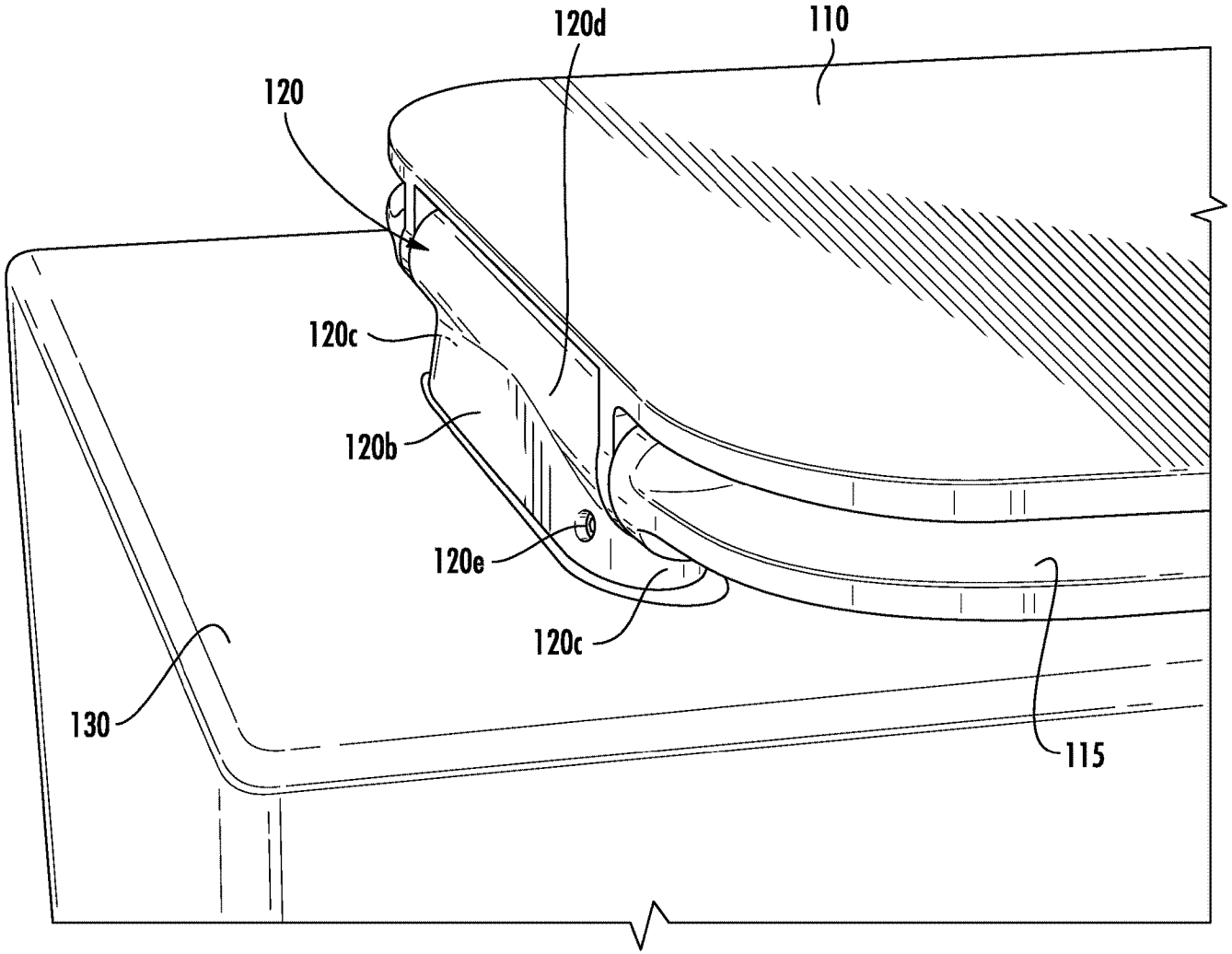
FIG. 3 is a partial perspective view of the plumbing fixture assembly of FIG. 1.
Figure 4:
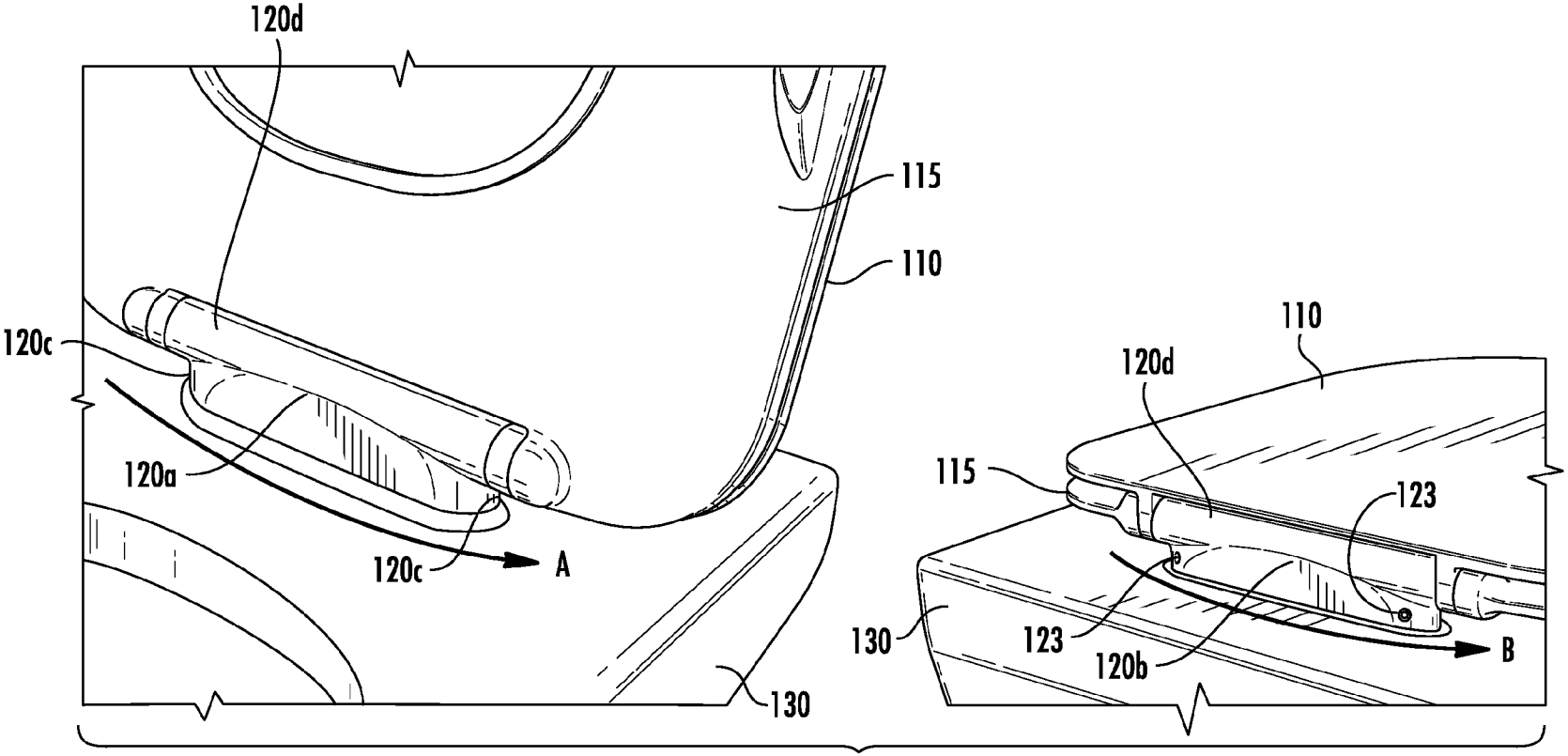
FIG. 4 is a partial perspective view of the plumbing fixture assembly of FIG. 1 illustrating a cleaning path around the lid and seat assembly, according to an exemplary embodiment.
Figure 5:
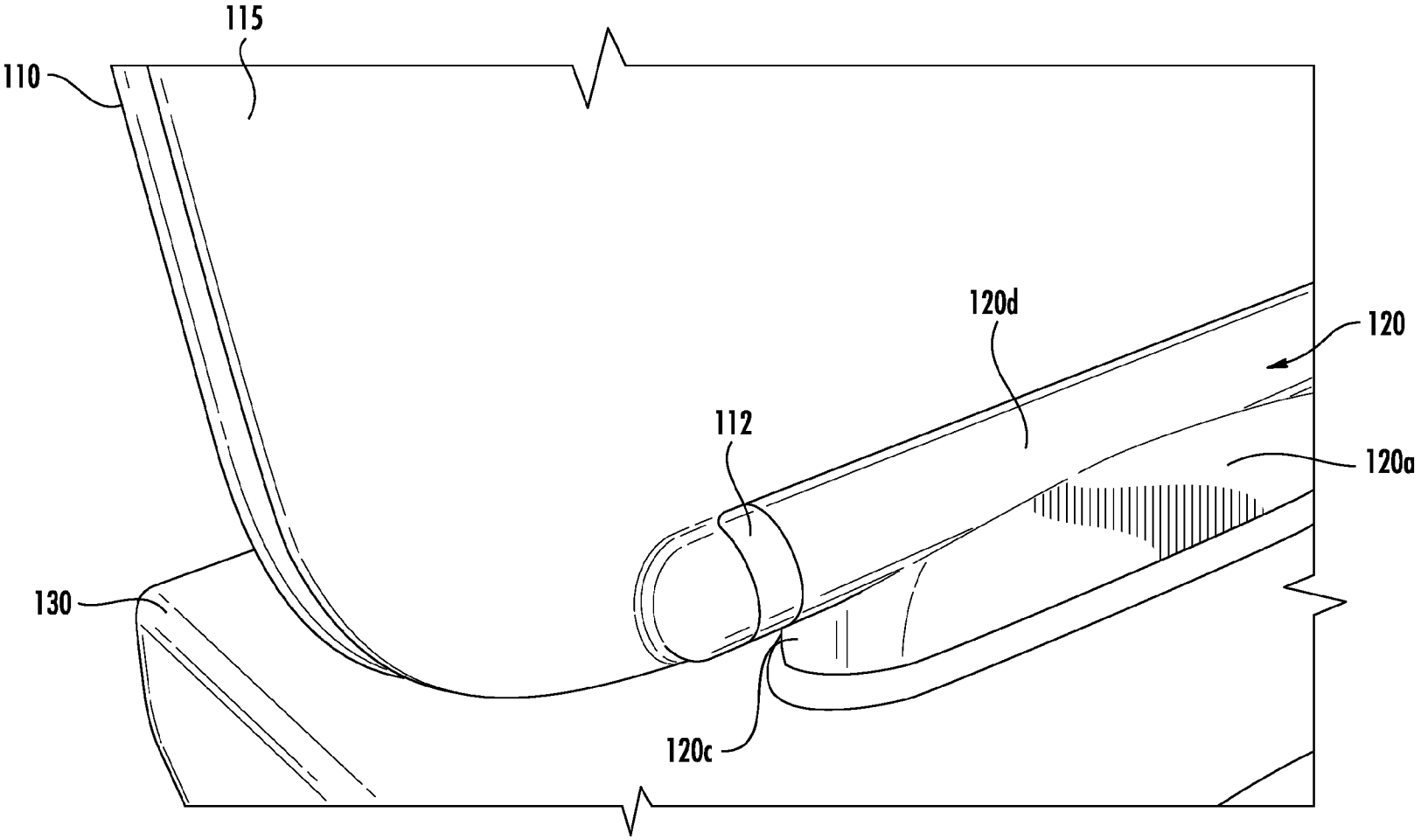
FIG. 5 is a partial perspective view of the plumbing fixture assembly of FIG. 1.

Referring to FIGS. 3-5, the housing 120 has a monolithic, one-piece structure that facilitates "single-wipe" cleaning at the front and/or rear of the housing 120, near the interface between the housing 120 and the toilet 130. For example, as shown in FIGS. 3-5, the housing 120 has a generally planar front surface 120*a* (e.g., a first surface, etc.) and a generally planar rear surface 120*b* (e.g., a second surface, etc.), each extending downward toward the toilet 130. The front surface 120*a* and the rear surface 120*b* are each oriented in a substantially upright direction and have a generally planar shape. The front surface 120*a* and the rear surface 120*b* each terminate or meet at a single, common edge 120*c* (e.g., corner, etc.) located at opposite ends of the housing 120 (e.g., at a first end and at a second end of the housing 120). According to the exemplary embodiment shown, the edges 120*c* have a curved shape (e.g., rounded, filleted, etc.). Thus, the housing 120 does not include planar or flat side surfaces, but instead includes curved edges 120*c* where the front surface 120*a* and the rear surface 120*b* both terminate or meet. In other words, the front surface 120*a* and the rear surface 120*b* extend continuously to the common edges 120*c* located at opposite ends of the housing 120, so as to cooperatively define a continuous surface profile. This structure, advantageously, allows for cleaning at or around the housing 120 by a single pass or a single wipe (e.g., using a rag, etc.) at each of the front and rear of the housing 120. That is to say, a person cleaning at or around the housing 120 can clean the entire front surface 120*a* by making a single pass or a single wipe along the front surface 120*a* between the edges 120*c* with a rag or the like, and can clean the entire rear surface 120*b* by making a single pass or wipe along the rear surface 120*b* between the edges 120*c*.

For example, as shown in FIG. 4, the front surface 120*a* can be cleaned by a single pass or wipe by a person cleaning the toilet 130 along a path indicated generally by arrow "A." Similarly, the rear surface 120*b* can be cleaned by a single pass or wipe by a person cleaning the toilet 130 along a path indicated generally by arrow "B." Thus, the portion of the housing 120 at or near the interface of the housing and the toilet 130 can be cleaned by a minimum of two wipes or passes along the front and rear of the housing 120. This can minimize the time and effort required by a user to clean at or around the housing 120. Furthermore, the geometry of the housing 120 (e.g., the continuous surface profile extending between the common edges 120*c*) can result in a more thorough cleaning of the lid and seat assembly due to a fewer number of surfaces to clean.

Figure 10:
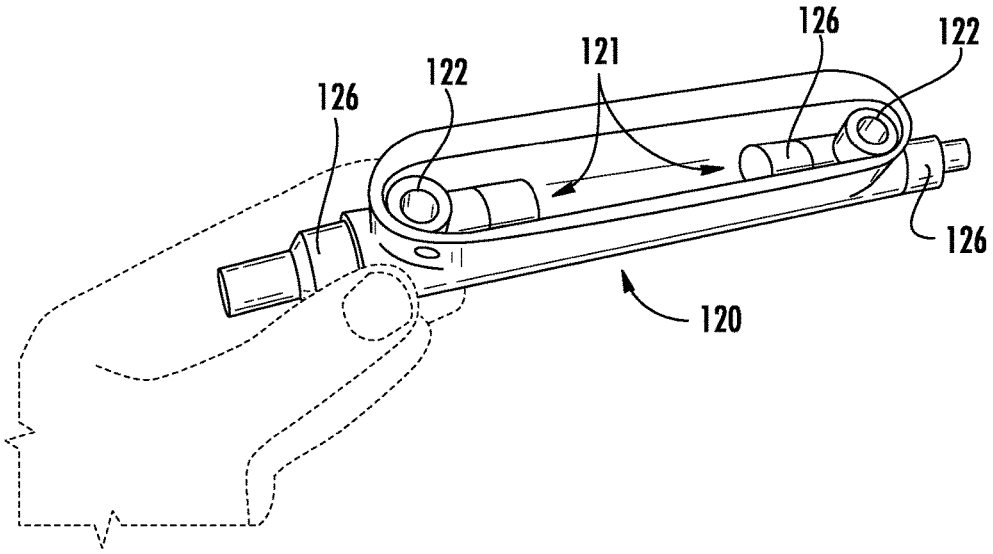
FIGS. 10-15 illustrate a method of installing dampers into a housing, and installing the housing to a plumbing fixture lid and seat.

Still referring to FIGS. 3-5, the housing 120 includes an upper portion 120*d* having a generally hollow, cylindrical shape (e.g., tubular, etc.). The hollow, cylindrical shape of the upper portion 120*d* defines internal openings 121, shown in FIG. 10. The upper portion 120*d* extends outward from each end of the housing 120, past each of the edges 120*c*. The front surface 120*a* and the rear surface 120*b* each extend downward from the upper portion 120*d* a distance sufficient to provide a gap between the upper portion 120*d* and the toilet 130. This gap can, advantageously, facilitate access to the space between the seat 115 and the toilet 130 for cleaning or the like. The housing 120 includes a smooth, blended surface transition between the front/rear surfaces 120*a*/120*b* and the upper portion 120*d*, thereby minimizing the number of crevices or sharp edges on the housing 120 where dirt and bacteria can collect. In addition, an outer surface of the upper portion 120*d* is substantially flush with a rear surface of the lid 110 and a rear surface of the seat 115, as shown in FIG. 3. This further helps to facilitate cleaning of the lid and seat assembly by minimizing the number of gaps or spaces between surfaces.

Figure 6:
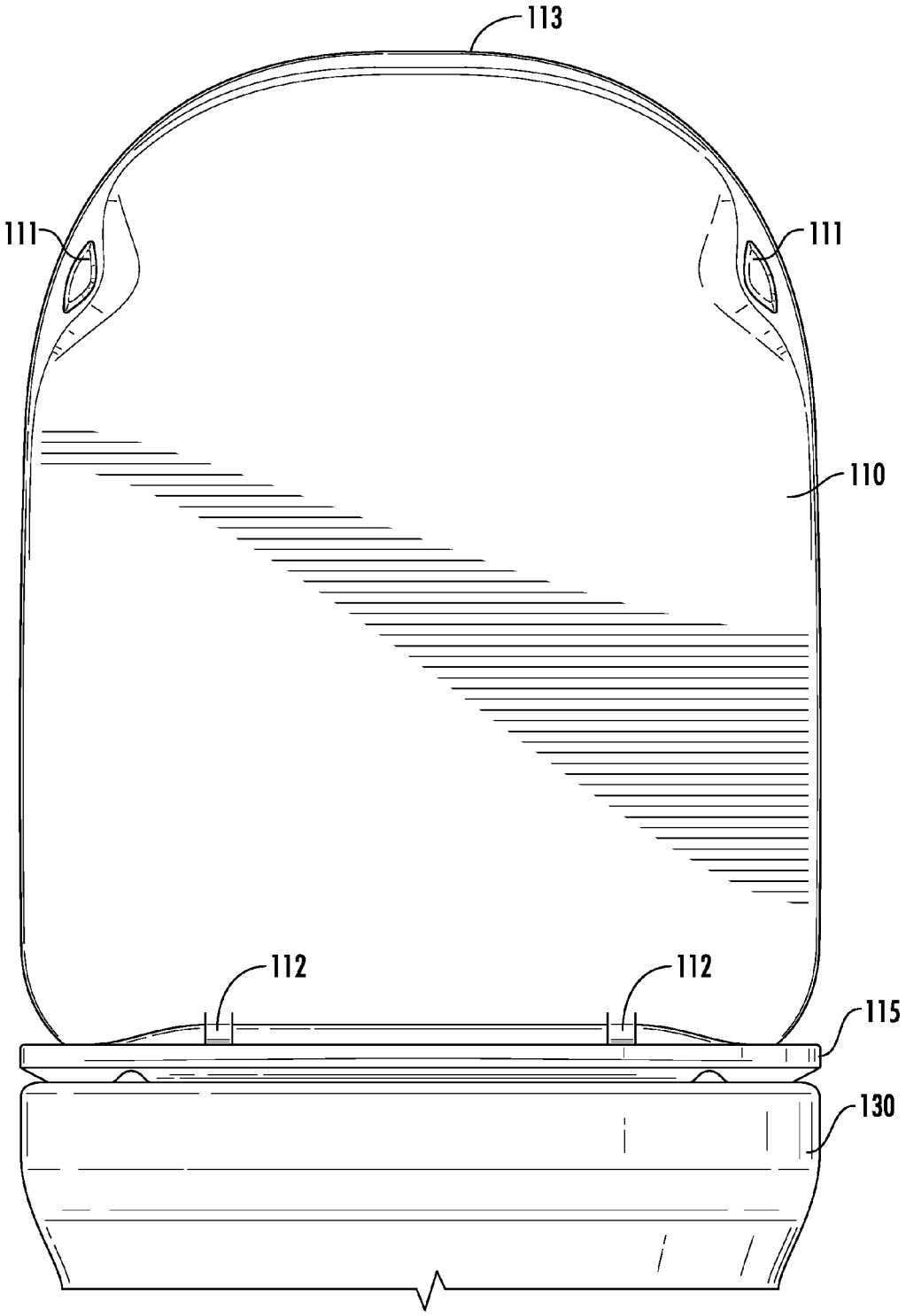
FIG. 6 is a front view of the plumbing fixture assembly of FIG. 1 with the lid shown in an up position.
Figure 12:
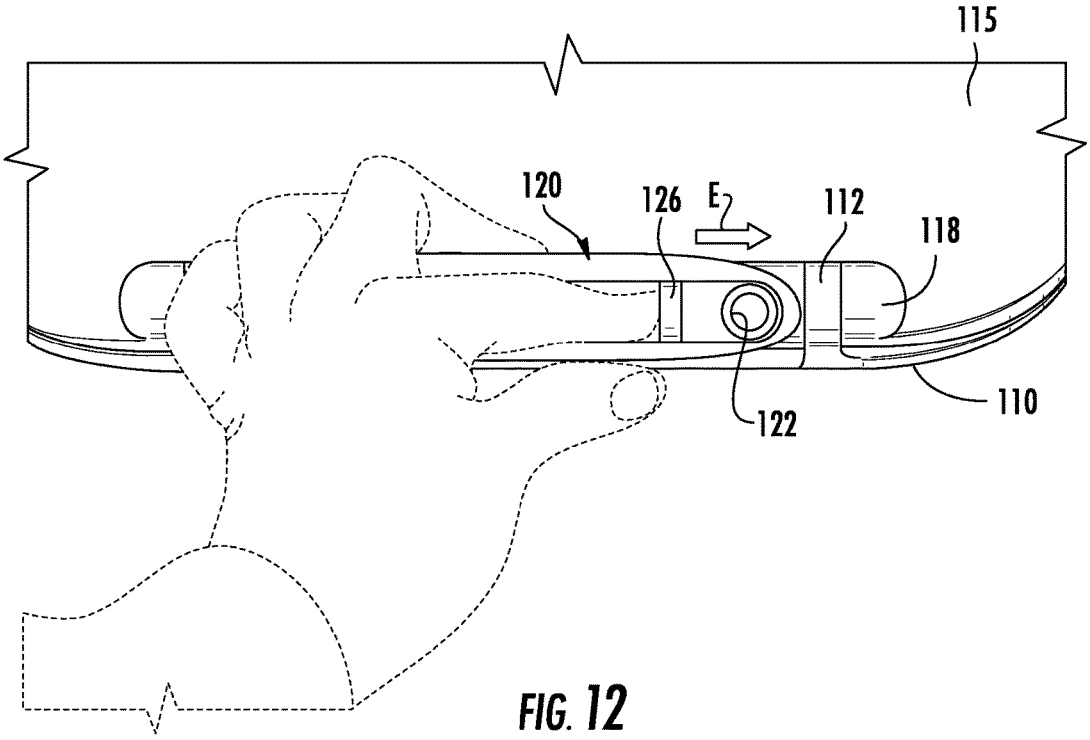

Referring to FIGS. 5-6, the lid 110 and the seat 115 are each pivotably coupled to the housing 120 at the cylindrical portion 120*d*. The lid 110 includes a lip 113 (e.g., a recessed portion, etc.) defining a localized gap or area for a user to lift the lid 110 without contacting the seat 115 with their finger(s) (also illustrated in FIG. 1). The lid 110 includes a pair of members 112 extending from the lid 110 for pivotably coupling the lid 110 to the housing 120. According to the exemplary embodiment of FIGS. 5 and 6, each of the members 112 has a hollow cylindrical shape (e.g., ring shape, etc.) for receiving at least a portion of a damper 126 therethrough (see FIGS. 9 and 12). The lid 110 can be rotated relative to the housing 120 via the members 112 and the dampers 126. Similarly, the seat 115 includes a pair of pivot ends 118 for receiving a portion of the dampers 126 therein (see FIGS. 8-9). The pivot ends 118 have a generally cylindrical shape and an inner cavity for receiving a portion of the dampers 126 therein. The seat 115 can be rotated relative to the housing 120 via the pair of pivot ends 118 and the dampers 126. According to an exemplary embodiment, the lid 110 and the seat 115 can be rotated/pivoted independently of each other.

Referring to FIG. 6, the lid 110 includes a pair of feet 111 located opposite each other along a periphery of the lid.

According to other exemplary embodiments, the lid 110 includes more or fewer than two feet 111. The feet 111 extend outwardly from an underside of the lid 110 and have a generally tapered shape, thereby minimizing the contact area or contact surface of the feet with the seat 115 to facilitate cleaning around the feet. The feet 111 can contact an upper surface of the seat 115 when the lid is at a down or closed position. The feet 111 and the underside of the lid 110 each have a generally smooth, blended surface transition that minimizes or eliminates crevices and sharp corners where dirt and bacteria can collect. Furthermore, the feet 111 have a structure and shape that facilitates single-wipe cleaning along an inner portion and along an outer portion of each of the feet 111, the details of which are discussed in the paragraphs that follow.

Figure 7A:
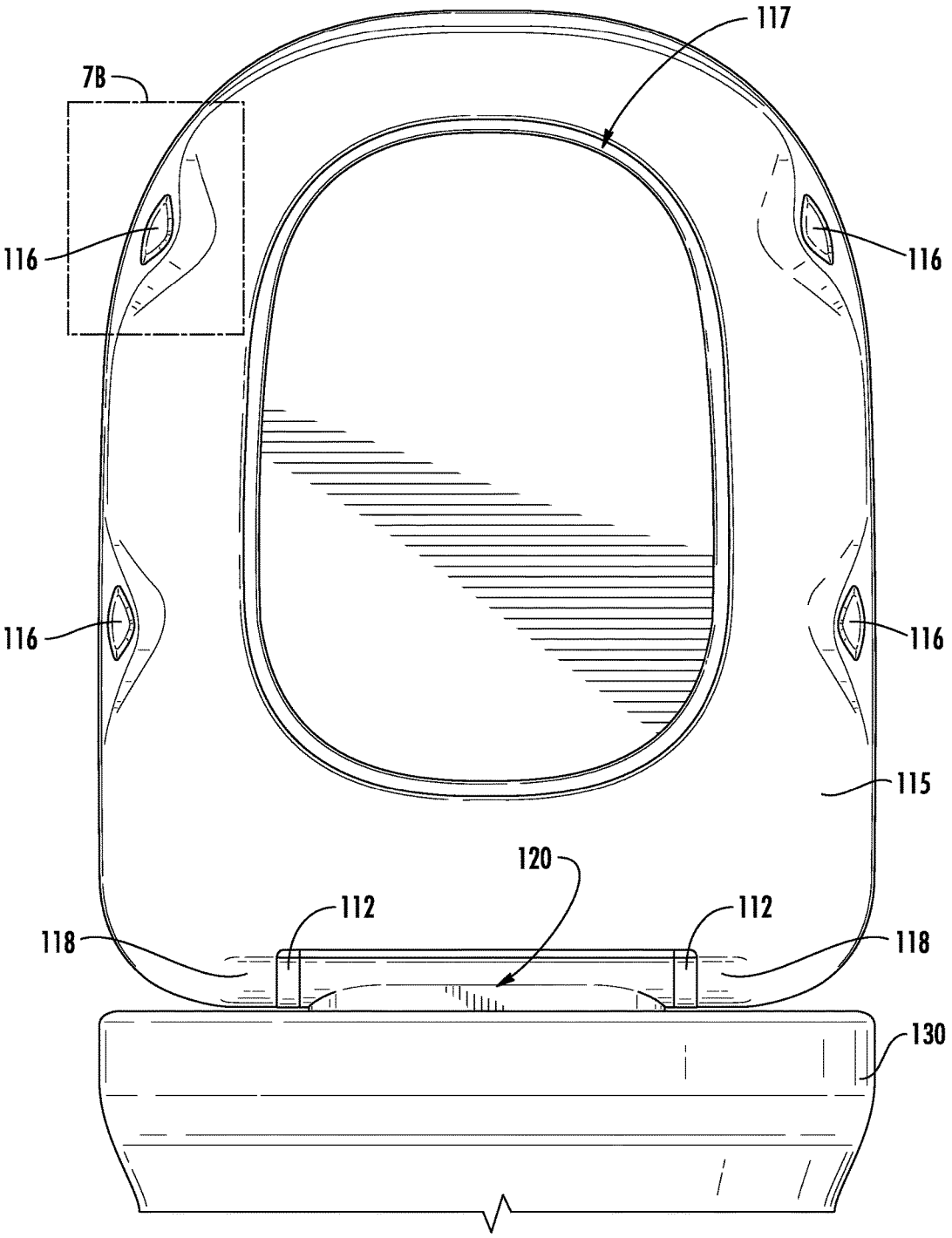
FIG. 7A is a front view of the plumbing fixture assembly of FIG. 1 with the lid and seat shown in an up position.
Figure 7B:
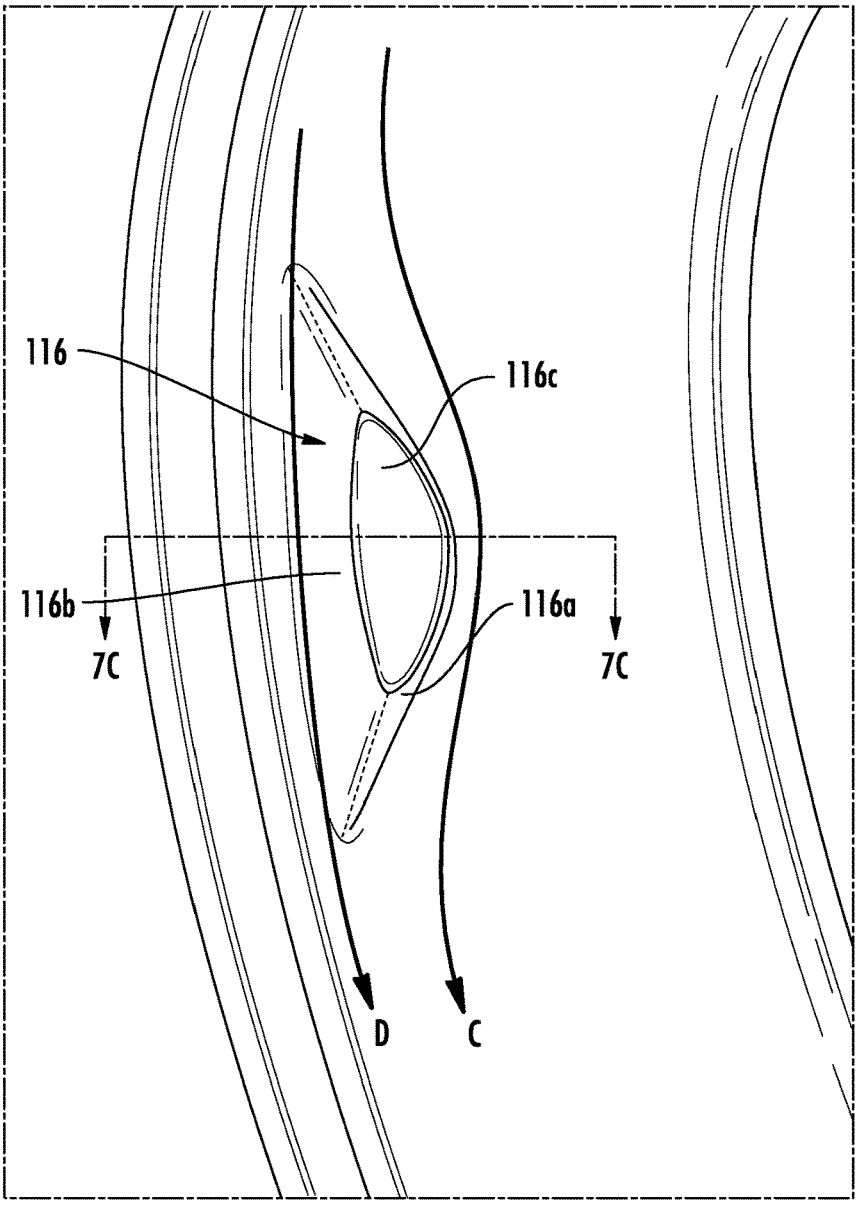
FIG. 7B is a detail view of a portion of the plumbing fixture assembly of FIG. 7A.
Figure 7C:
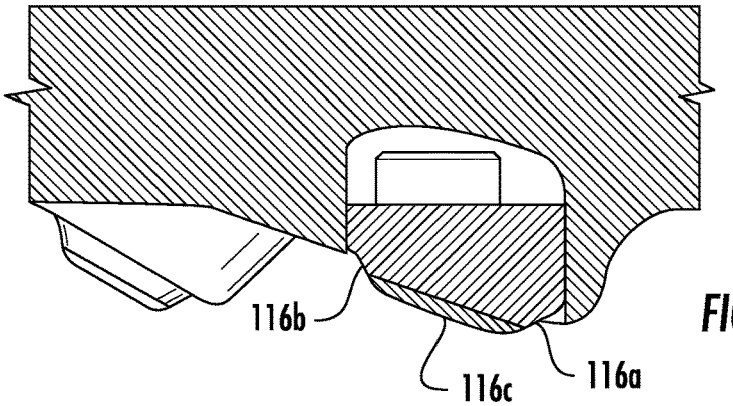
FIG. 7C is a partial cross-sectional view of the portion of the plumbing fixture assembly of FIG. 7B.

Referring to FIGS. 7A-7C, the seat 115 includes a plurality of feet 116 located along a periphery of the seat. The seat 115 also includes an opening 117 to provide access to the bowl of the toilet 130. The feet 116 have a similar structure and shape as the feet 111 to provide for a cohesive appearance between the lid 110 and the seat 115. However, the feet 116 may have a different structure (e.g., a different size, etc.) and shape than the feet 111, according to other exemplary embodiments. The feet 116 extend outwardly away from an underside of the seat 115 and have a generally tapered shape. As shown in FIG. 7B, the feet 116 have a bottom surface 116*c* that is oriented at an angle for engaging a complementary angled surface (e.g., frusto-conical surface, tapered surface, etc.) of the bowl. For example, according to an exemplary embodiment, the bowl of the toilet 130 includes a rim 131 (see FIG. 8) having an angled surface that tapers inwardly toward a center of the bowl to define a frusto-conical shape. The feet 116 each have a bottom surface 116*c* that is oriented at an angle that is complementary to the angled surface of the rim 131, such that the feet 116 can engage the rim 131 when the seat 115 is at a down position. This structure of the toilet rim 131 and feet 116, advantageously, allows for fluids (e.g., cleaners, bodily fluids, etc.) that may be present on the rim 131 and/or feet 116 to be directed away from the rim and seat toward an interior portion of the bowl, thereby facilitating a cleaner more sanitary environment.

FIG. 7B is a detail view of one the feet 116 shown in FIG. 7A. The following discussion applies similarly to the feet 111 of the lid 110 shown in FIG. 6, as both feet 111 and feet 116 have a similar structure and shape, according to the exemplary embodiment shown in the Figures. As shown in FIG. 7A, the foot 116 includes an arcuate inner surface 116*a* and an arcuate outer surface 116*b*. The inner surface 116*a* and the outer surface 116*b* both terminate or meet at a common edge located at each end of the foot 116, which are indicated generally by dashed lines in FIG. 7B. According to the exemplary embodiment shown, the common edges have a generally curved or arcuate shape. The outer surface 116*b* generally follows or mimics the outer contour of the seat 115, according to an exemplary embodiment. This structure, advantageously, allows for single-wipe cleaning of the foot 116, similar to the housing 120. For example, a user can clean the inner surface 116*a* by a single wipe or a single pass with a rag or the like along a path indicated generally by arrow "C." Likewise, the user can clean the outer surface 116*b* by a single wipe or a single pass along a path indicated generally by arrow "D." Thus, the entire foot 116 can be cleaned by a minimum of two passes or wipes, due to its structural shape. Furthermore, the foot 116 has a generally smooth, blended surface transition to the seat 115, which allows for easier cleaning of and around the foot 116 on the seat.

Figure 8:
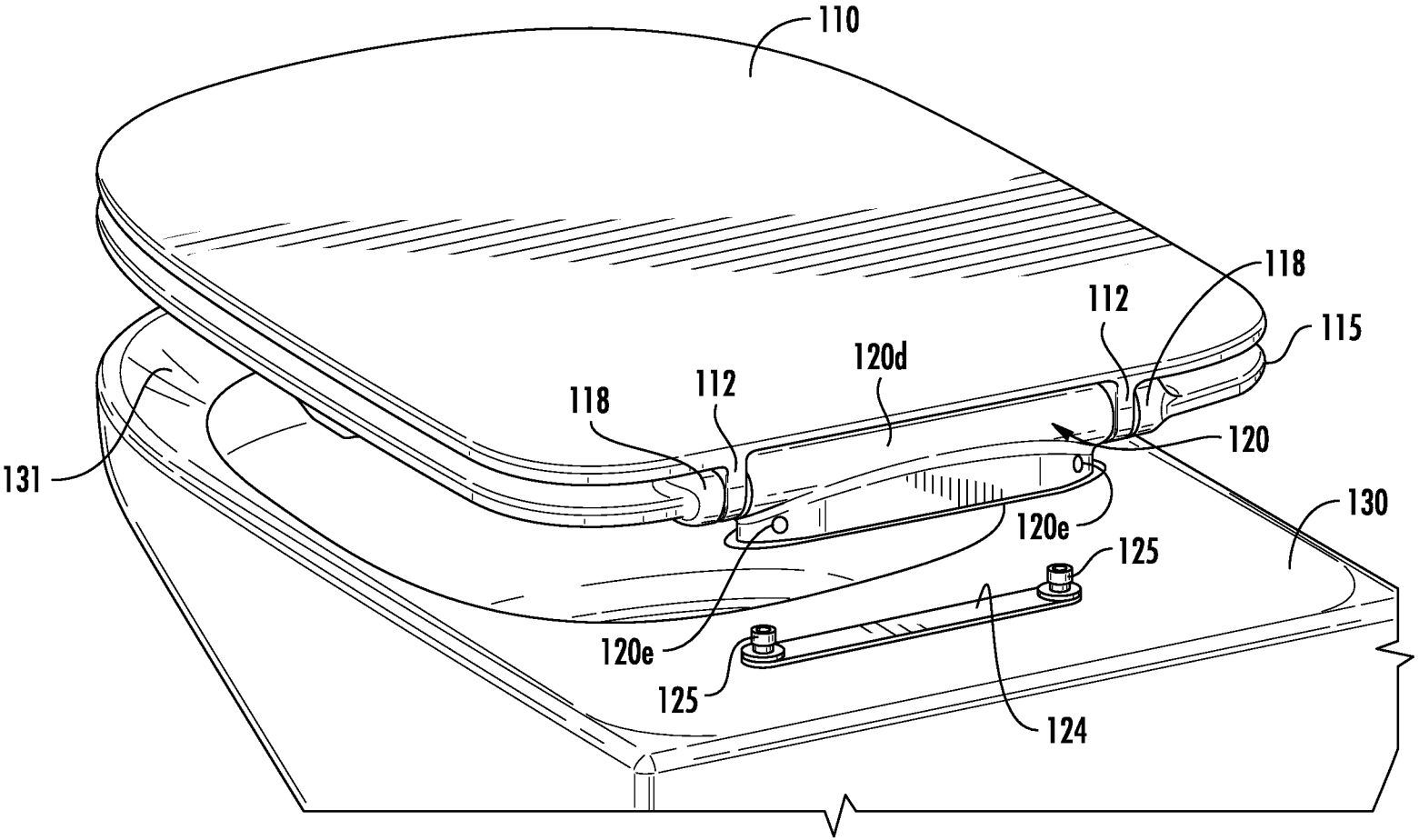
FIG. 8 is an exploded view illustrating the installation of a lid and seat assembly to a plumbing fixture according to an exemplary embodiment.
Figure 9:
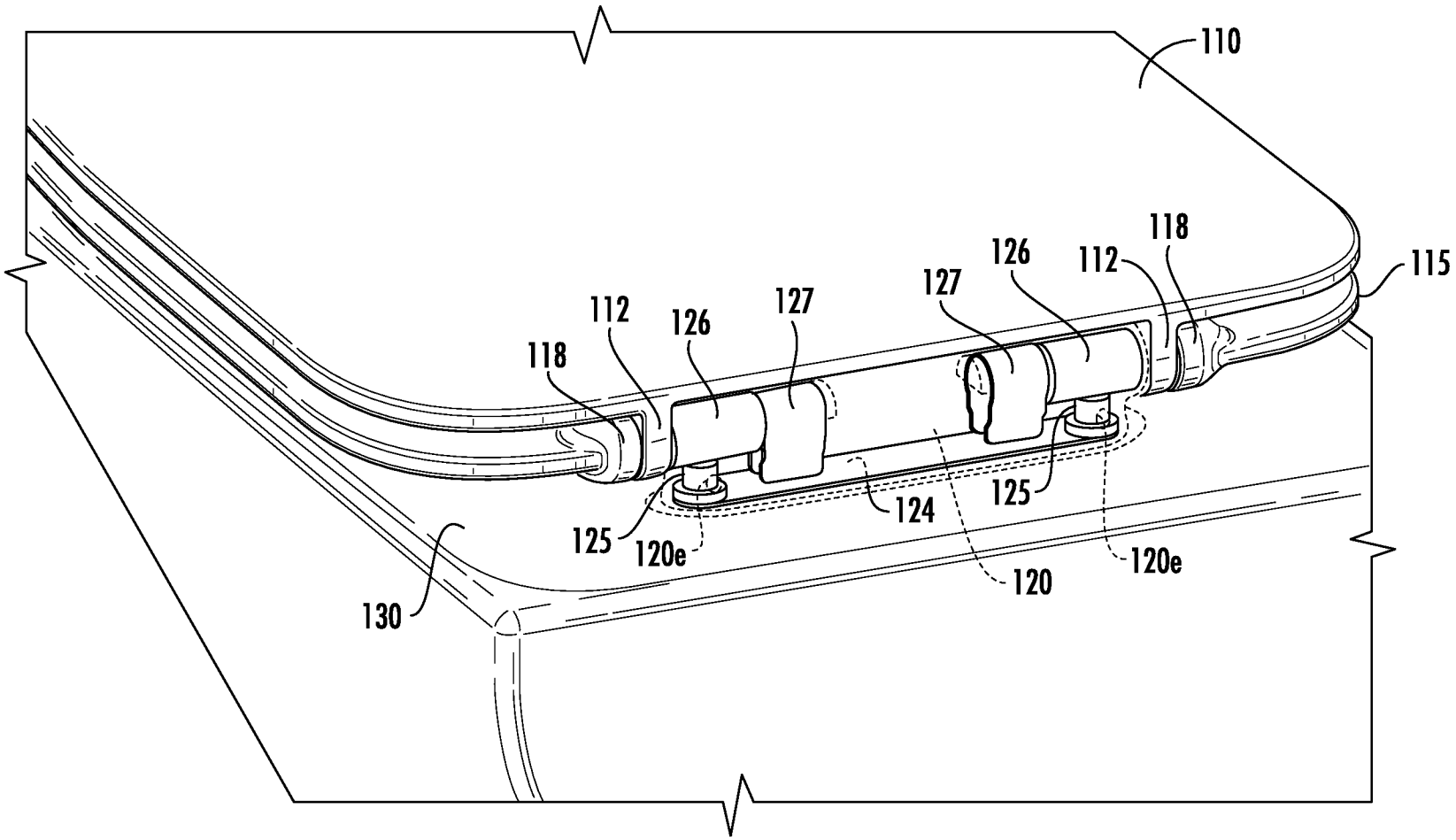
FIG. 9 is a partial perspective view of the plumbing fixture assembly of FIG. 1 with a housing shown in phantom.

Referring to FIGS. 8-9, the lid 110, the seat 115, and the housing 120 are shown coupled together as a lid and seat assembly. The lid and seat and seat assembly is shown disassembled from the toilet 130 in FIG. 8. As shown in FIG. 8, the lid and seat assembly can be coupled to the toilet 130 by a pair of posts 125 (e.g., dowels, rods, etc.) and a generally planar member 124 (e.g., gasket, plate, etc.). According to an exemplary embodiment, the pair of posts 125 can be, for example, bolts extending up through respective openings in the toilet 130. According to other exemplary embodiments, the posts 125 can be another type of rigid member that protrudes above an upper surface of the toilet 130. According to an exemplary embodiment, the pair of posts 125 are coupled to the toilet 130 through respective openings in the toilet 130 via one or more fasteners (e.g., nuts, set screws, adhesive, etc.). The posts 125 can locate and couple the lid and seat assembly to a plumbing fixture, such as the toilet 130.

According to the exemplary embodiment of FIGS. 8-9, the posts 125 couple the generally planar member 124 to the upper surface of the toilet 130 by sandwiching the planar member 124 between a portion of the posts 125 and the toilet 130. According to an exemplary embodiment, the planar member 124 can locate the posts 125 relative to the toilet 130. The planar member 124 can receive the housing 120 at an upper surface thereof. According to an exemplary embodiment, the generally planar member 124 is made from a polymeric material (e.g., rubber, plastic, etc.) that can act as an intermediate layer to prevent the housing 120 from directly contacting the toilet 130 when the housing 120 is coupled to the toilet 130. This can, advantageously, prevent metal-on-ceramic contact to prevent damaging the toilet 130, where the housing 120 includes features made of metal and the toilet 130 is made of a ceramic material, such as porcelain, vitreous china, or the like, according to an exemplary embodiment.

According to the exemplary embodiment shown in FIGS. 8-9, at least a portion of the posts 125 can be received within respective openings 122 (see FIGS. 10-11) of the housing 120, such that the posts 125 are aligned with a respective aperture 120*e* on the housing when the housing is coupled to the toilet 130. The apertures 120*e* are oriented substantially perpendicular to the openings 122. According to an exemplary embodiment, the apertures 120*e* are defined by a threaded portion configured to threadably receive a fastener 123 (e.g., a set screw, etc.) therein. A portion of each of the posts 125 is accessible through the apertures 120*e*, such that the fasteners 123 can engage the posts 125 to create an interference condition when the fasteners 123 are threaded through the apertures 120*e*. In this manner, the lid and seat assembly can be removably coupled to the toilet 130 by an interface between the fasteners 123 and the posts 125. According to other exemplary embodiments, the plumbing fixture assembly includes more or fewer than two posts 125 and/or fasteners 123.

Still referring to FIG. 9, the housing 120 is shown in phantom to illustrate additional components of the plumbing fixture assembly. As shown in FIG. 9, the assembly further includes a pair of dampers 126 arranged at opposite ends of the housing 120 within the upper portion 120*d* at respective openings 121. The dampers 126 are coupled within the upper portion 120*d* by clips 127, according to an exemplary embodiment. A portion of the dampers 126 extends outwardly away from the housing 120 through the members 112 and into the pivot ends 118 at each end of the housing 120. In this way, the dampers 126 can pivotably couple the lid 110 and the seat 115 to the housing 120. The dampers 126 can, advantageously, regulate or dampen the opening/closing of the lid 110 and the seat 115 to, for example, prevent slamming of the lid and seat by a user.

Referring to FIGS. 9 and 10-15, an installation method for the dampers 126 in the housing 120 is illustrated according to an exemplary embodiment. The following method can be performed at the factory by the manufacturer and can, advantageously, simplify the installation process and can eliminate the need for on-site installation of the dampers by a user. For example, in a first step illustrated in FIG. 10, an installer can insert the pair of dampers 126 into the housing 120 through respective openings 121 located within the upper portion 120*d* of the housing. The dampers 126 can be slid through the respective openings 121 such that at least a portion of the dampers 126 extends outwardly from the housing 120 past each end of the housing.

Figure 11:
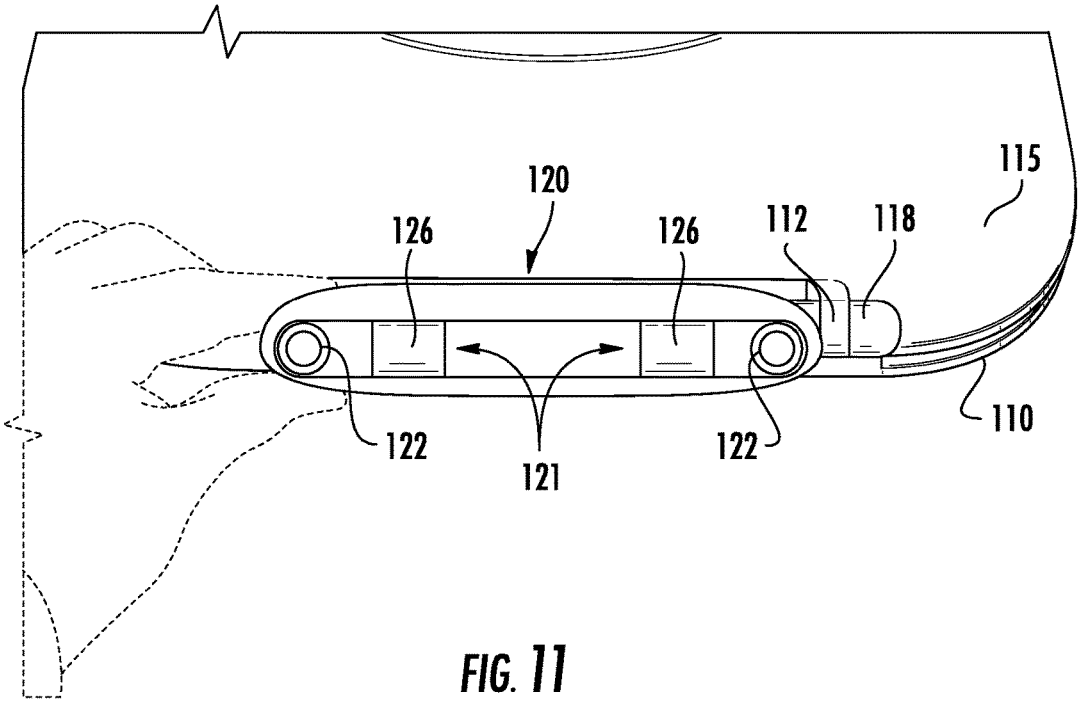

In a second step shown in FIG. 11, the installer can align the housing 120 with the lid 110 and the seat 115, by aligning the dampers 126 with respective openings defined by the members 112 and the pivot ends 118. In a third step shown in FIG. 12, an installer can slide the damper 126 outwardly in a direction indicated generally by arrow "E," such that a portion of the damper 126 is inserted through the member 112 and into the pivot end 118 of the seat 115. The same process can be repeated at an opposite end of the housing 120 with a second damper 126, but in a direction opposite to the direction indicated by arrow "E."

Figure 13:
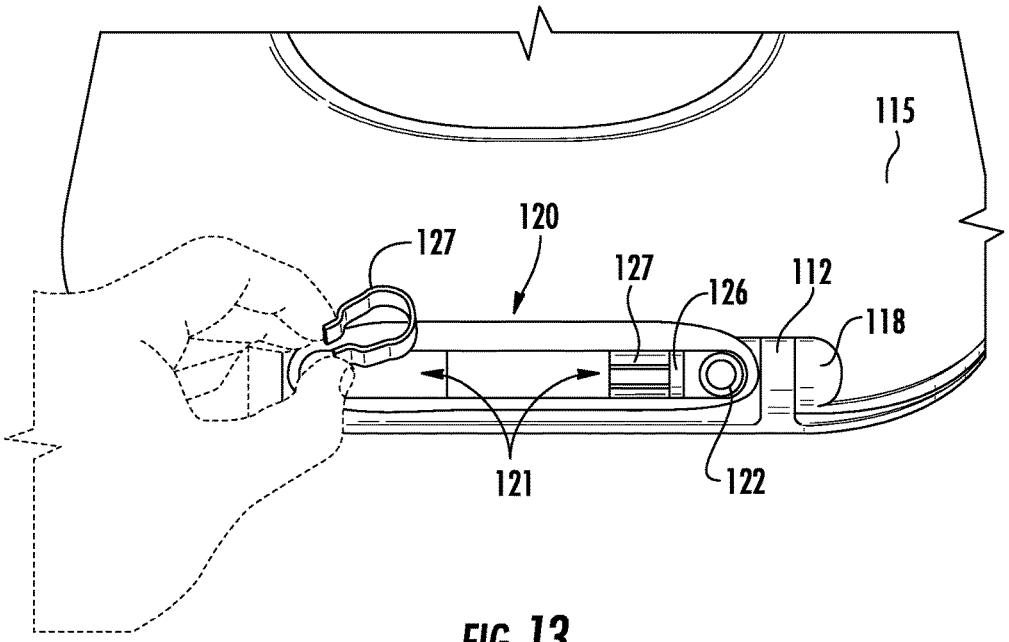
Figure 14:
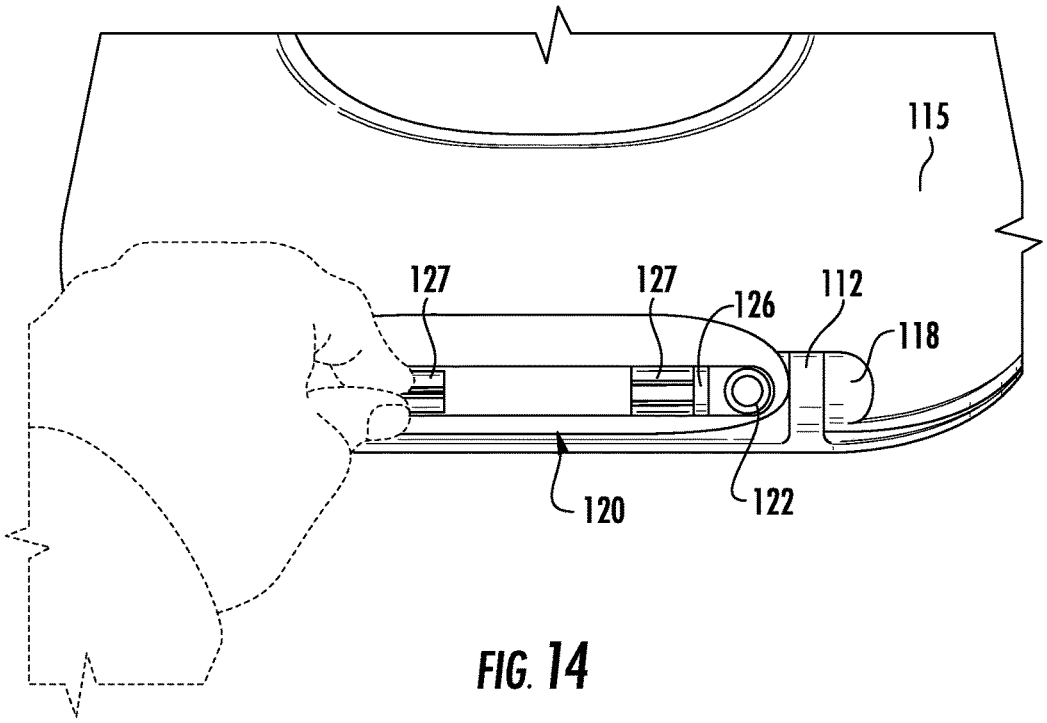
Figure 15:
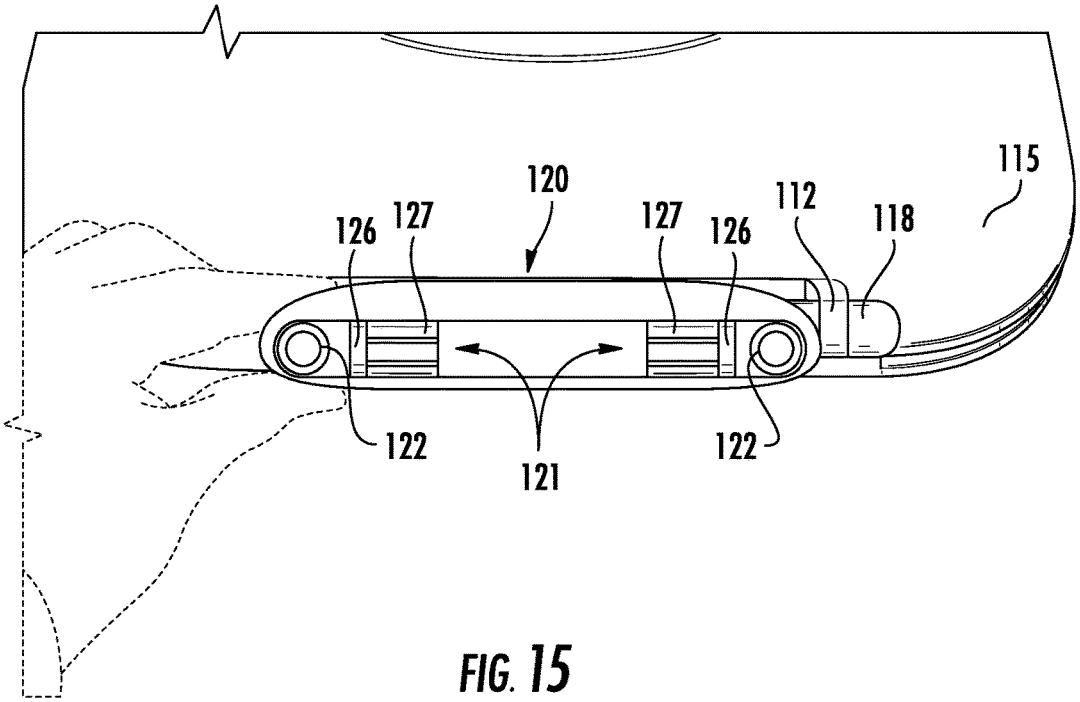

In a fourth step shown in FIGS. 13-14, an installer can insert a clip 127 adjacent each of the dampers 126 to couple the dampers 126 within the housing 120. The clips 127 can act to locate the dampers 126 along an axial direction within the housing 120, and can prevent the dampers 126 from decoupling from the lid 110 and the seat 115 (e.g., sliding in an axial direction within the housing 120). According to the exemplary embodiment of FIG. 13, the clips 127 are spring clips. According to other exemplary embodiments, the clips 127 are another type of element capable of retaining the dampers 126 within the housing 120. FIG. 15 illustrates a fully assembled lid and seat assembly for a plumbing fixture, with the lid 110 and the seat 115 pivotably coupled to the housing 120.

According to an exemplary embodiment, the housing 120 is made from a semi-rigid or a rigid material, or combinations of materials, such as metal, plastic, composite, or the like. According to an exemplary embodiment, the lid 110 and the seat 115 are made from a semi-rigid or a rigid material, or combinations of materials, such as plastic, vinyl, rubber, composite, metal, or the like. According to other exemplary embodiments, the housing 120, the lid 110, and the seat 115 may be made from any other semi-rigid or rigid material, or combinations of materials, that are suitable for use in a bathing environment.

The lid and seat assembly disclosed herein, including the lid 110, the seat 115, and the housing 120, is designed to minimize the accumulation of dirt and bacteria around the plumbing fixture, provide for improvements relating to cleanliness and maintenance thereof, and provide for a simplified assembly process for lid and seat dampers.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A lid and seat assembly for a plumbing fixture, comprising:

a housing including a front surface and a rear surface;

a lid pivotably coupled to the housing; and a seat pivotably coupled to the housing;

wherein the front surface and the rear surface meet at a first side of the housing and at a second side of the housing;

wherein the housing further comprises a cylindrical portion disposed above, and extending outwardly past, each of the first side and the second side; and wherein the first side and the second side are each curved to define a continuous surface profile with the front surface and the rear surface below the cylindrical portion.

2. The assembly of claim 1, wherein the front surface and the rear surface are oriented substantially upright.

3. The assembly of claim 1, wherein the cylindrical portion includes an outer surface that is flush with a rear surface of the lid and a rear surface of the seat.

4. The assembly of claim 3, further comprising a damper disposed within the cylindrical portion;

wherein a portion of the damper extends through the cylindrical portion outwardly past the first side or the second side of the housing.

5. The assembly of claim 4, wherein the portion of the damper extends through the lid and into the seat to pivotably couple the lid and the seat to the housing, and wherein the lid and the seat are each configured to pivot relative to the housing via the damper.

6. The assembly of claim 1, wherein the housing includes an opening configured to receive a post extending upward from a plumbing fixture to locate and couple the lid and seat assembly to the plumbing fixture.

7. The assembly of claim 6, wherein the housing includes an aperture disposed in the housing adjacent the opening, and wherein the aperture is configured to receive a fastener therein for engaging the post to couple the lid and seat assembly to the plumbing fixture.

8. A lid and seat assembly for a plumbing fixture, comprising:

a housing configured to be coupled to a plumbing fixture and including a front surface and a rear surface located opposite the front surface;

a lid pivotably coupled to the housing; and a seat pivotably coupled to the housing;

wherein the front surface and the rear surface meet at a first side and a second side located opposite the first side;

wherein the housing further comprises a cylindrical portion disposed above, and extending outwardly past, each of the first side and the second side; and wherein the first side and the second side are each curved to define a continuous upright surface with the front surface and the rear surface below the cylindrical portion.

9. The assembly of claim 8, wherein the first surface and the second surface are oriented substantially upright.

10. The assembly of claim 8, wherein the cylindrical portion includes an outer surface that is flush with a rear surface of the lid and a rear surface of the seat.

11. The assembly of claim 10, further comprising a damper disposed within the cylindrical portion;

wherein a portion of the damper extends through the cylindrical portion outwardly past the first side of the housing.

12. The assembly of claim 11, wherein the portion of the damper extends through the lid and into the seat to pivotably couple the lid and the seat to the housing.

13. The assembly of claim 8, wherein the housing includes an opening configured to receive a post extending upward from the plumbing fixture to locate and couple the lid and seat assembly to the plumbing fixture.

14. The assembly of claim 13, wherein the housing includes an aperture disposed in the housing adjacent the opening, and wherein the aperture is configured to receive a fastener therein for engaging the post to couple the lid and seat assembly to the plumbing fixture.

15. A plumbing fixture assembly, comprising:

a plumbing fixture; and a lid and seat assembly removably coupled to the plumbing fixture, the lid and seat assembly comprising:

a housing removably coupled to the plumbing fixture and including a front surface and a rear surface located opposite the front surface;

a lid pivotably coupled to the housing; and a seat pivotably coupled to the housing;

wherein the front surface and the rear surface meet at a first side and a second side of the housing;

wherein the housing further comprises a cylindrical portion disposed above, and extending outwardly past, each of the first side and the second side;

wherein the first side and the second side are each curved to define a continuous upright surface with the front surface and the rear surface between the cylindrical portion and the plumbing fixture; and wherein the lid and the seat are each configured to be pivoted relative to the housing and the plumbing fixture.

16. The assembly of claim 15, wherein the cylindrical portion includes an outer surface that is flush with both a rear surface of the lid and a rear surface of the seat.

17. The assembly of claim 16, further comprising a damper disposed within the cylindrical portion;

wherein a portion of the damper extends through the cylindrical portion outwardly past the first side of the housing.

18. The assembly of claim 17, wherein the portion of the damper extends through the lid and into the seat to pivotably couple the lid and the seat to the housing.

19. The assembly of claim 15, further comprising a post extending upward from an upper surface of the plumbing fixture;

wherein the housing includes an opening for receiving the post to locate and couple the lid and seat assembly to the plumbing fixture.

20. The assembly of claim 19, further comprising a fastener threadably received through a portion of the housing and engaging the post to couple the lid and seat assembly to the plumbing fixture.

* * * * *